US007078367B2

(12) United States Patent
Laney et al.

(10) Patent No.: US 7,078,367 B2
(45) **Date of Patent: *Jul. 18, 2006**

(54) THERMAL-DYE-TRANSFER RECEIVER ELEMENT WITH POLYLACTIC-ACID-BASED SHEET MATERIAL

(75) Inventors: Thomas M. Laney, Spencerport, NY (US); Kenneth W. Best, Jr., Hilton, NY (US)

(73) Assignee: Eastman Kodak Company, Rochester, NY (US)

( * ) Notice: Subject to any disclaimer, the term of this patent is extended or adjusted under 35 U.S.C. 154(b) by 154 days.

This patent is subject to a terminal disclaimer.

(21) Appl. No.: 10/783,103

(22) Filed: Feb. 20, 2004

(65) Prior Publication Data

US 2005/0187105 A1 Aug. 25, 2005

(51) Int. Cl.
*B41M 5/035* (2006.01)
*B41M 5/38* (2006.01)

(52) U.S. Cl. ..... 503/227

(58) Field of Classification Search ..... 503/227; 8/471

See application file for complete search history.

(56) References Cited

U.S. PATENT DOCUMENTS

| | | | |
|---|---|---|---|
| 4,621,271 | A | 11/1986 | Brownstein |
| 5,100,862 | A | 3/1992 | Harrison et al. |
| 6,096,684 | A | 8/2000 | Sasaki et al. |
| 6,638,893 | B1 | 10/2003 | Laney et al. |

FOREIGN PATENT DOCUMENTS

| | | |
|---|---|---|
| EP | 0 582 750 A1 | 2/1994 |
| JP | 63-198645 | 8/1988 |

*Primary Examiner*—B. Hamilton Hess
(74) *Attorney, Agent, or Firm*—Chris P. Konkol

(57) ABSTRACT

Disclosed is a thermal dye-transfer dye-image receiving element comprising a thermal dye-transfer receiver element comprising a dye-receiving layer 1; beneath layer 1, a substrate layer 2 containing a microvoided layer 2 comprising, in a continuous phase, a polylactic-acid-based material, wherein microvoids in said microvoided layer provide a void volume of at least 25% by volume, and wherein at least about half of the microvoids are formed from void initiating particles less than 1.5 micrometer in average diameter; and beneath layer 2, an optional support layer 3.

36 Claims, No Drawings

THERMAL-DYE-TRANSFER RECEIVER ELEMENT WITH POLYLACTIC-ACID-BASED SHEET MATERIAL

CROSS-REFERENCE TO RELATED APPLICATIONS

Reference is made to commonly assigned, co-pending U.S. patent application by Thomas M. Laney et al. (87437) filed of even date herewith, titled "THERMAL-DYE-TRANSFER MEDIA FOR LABELS COMPRISING POLY (LACTIC ACID) AND METHOD OF MAKING THE SAME" and commonly assigned, U.S. patent application by Thomas M. Laney et al. (87871) filed of even date herewith, titled "THERMAL-DYE-TRANSFER MEDIA FOR LABELS COMPRISING POLY(LACTIC ACID) AND METHOD OF MAKING THE SAME."

FIELD OF THE INVENTION

This invention relates to a thermal-dye-transfer receiving element comprising an image-receiving layer 1, beneath that a microvoided layer 2 comprising a polylactic-acid-based material in which microvoids are formed during extrusion employing void initiators having an average diameter of under 1.5 micrometers.

BACKGROUND OF THE INVENTION

In recent years, thermal transfer systems have been developed to obtain prints from pictures that have been generated electronically. According to one way of obtaining such prints, an electronic picture is first subjected to color separation by color filters. The respective color-separated images are then converted into electrical signals. These signals are then operated on to produce cyan, magenta, and yellow electrical signals. These signals are then transmitted to a thermal printer. To obtain the print, a cyan, magenta, or yellow dye-donor element is placed face-to-face with a dye-receiving element. The two are then inserted between a thermal printing head and a platen roller. A line-type thermal printing head is used to apply heat from the back of the dye-donor sheet. The thermal printing head has many heating elements and is heated up sequentially in response to the cyan, magenta, and yellow signals. A color hard copy is thus obtained which corresponds to the original picture viewed on a screen. Further details of this process and an apparatus for carrying it out are set forth in U.S. Pat. No. 4,621,271 issued Nov. 4, 1986 to Brownstein, titled "APPARATUS AND METHOD FOR CONTROLLING A THERMAL PRINTER APPARATUS."

Dye-receiving elements used in thermal dye transfer generally comprise a polymeric dye-image receiving layer coated on a support. Supports are required to have, among other properties, adequate strength, dimensional stability, and heat resistance. For reflective viewing, supports are also desired to be as white as possible. Cellulose paper and plastic films have been proposed for use as dye-receiving element supports in efforts to meet these requirements. Recently, microvoided films formed by stretching an orientable polymer containing an incompatible organic or inorganic material have been suggested for use in dye-receiving elements.

Various arrangements have been proposed to improve the imaging quality of dye-image receiving layers in thermal dye-transfer elements. JP 88-198,645 suggests the use of a support comprising a polyester matrix with polypropylene particles as a dye donor element. EP 0 582750 A1 suggests the use of a non-voided polyester layer on a support.

U.S. Pat. No. 5,100,862 issued Mar. 31, 1992 to Harrison et al., titled "MICROVOIDED SUPPORTS FOR RECEIVING ELEMENT USED IN THERMAL DYE TRANSFER" relates to microvoided supports for dye-receiving elements used in thermal dye transfer systems. Polymeric microbeads are used as void initiators in a polymeric matrix to enable higher dye transfer efficiency. U.S. Pat. No. 6,096,684 issued Aug. 1, 2000 to Sasaki et al., titled "POROUS POLYESTER FILM AND THERMAL TRANSFER IMAGE-RECEIVING SHEET" relates to porous polyester films suitable as supports for receiving elements used in thermal dye transfer systems. Polymers immiscible with a polyester are used in a base layer while an adjacent layer, upon which a dye receiving layer (B) is formed, contains a polyester containing dispersed inorganic particles as void initiators. These inorganic particles are less than 1.0 μm in size. The porosity of layer (B) is specified to be not less than 20% by volume. A problem exists with this support, however, in that the hardness of the inorganic void initiators results in poor contact with the dye donor element. This results in low dye transfer efficiency for elements using such supports.

This problem was addressed by U.S. Pat. No. 6,638,893 issued Oct. 28, 2003 to Laney et al., titled "THERMAL DYE TRANSFER RECEIVER ELEMENT WITH MICROVOIDED SUPPORT" whereby the inorganic particles of layer (B) in U.S. Pat. No. 6,096,684 are replaced with polymeric microbeads. This significantly improved the dye transfer efficiency. This invention provides a thermal dye-transfer dye-image receiving element comprising a dye-receiving layer 1, a microvoided layer 2, beneath layer 1, containing a continuous phase polyester matrix having dispersed therein crosslinked organic microbeads and having a void volume of at least 25% by volume and, beneath layer 2, a microvoided layer 3 comprised of a continuous phase polyester matrix having dispersed therein non-crosslinked polymer particles that are immiscible with the polyester matrix of layer 3. The invention is said to provide a receiver exhibiting an improved combination of dye-transfer efficiency and tear strength.

It would be desirable to have a thermal-dye-transfer recording element for thermal dye transfer which exhibits a high dye transfer efficiency, which is capable of recording images (including color images) having high optical densities, high image quality, exhibits high gloss, and is capable of being manufactured at a relatively low cost.

SUMMARY OF THE INVENTION

The invention provides a thermal dye-transfer receiving element comprising:

(a) a dye-receiving layer 1; and (b) beneath layer 1, a microvoided layer comprising, in a continuous phase, a polylactic-acid-based material, wherein microvoids in the microvoided layer provide a void volume of at least 25 weight percent and wherein the microvoids are formed by employing relatively smaller size void initiators, including, for example, various inorganic particles that have an average particle diameter of less than 1.5 micrometers.

The invention is also directed to a method of thermal dye transfer and a thermal-dye-transfer assemblage.

In one embodiment of the invention, a substrate layer under the microvoided layer is non-voided. In a second embodiment, the substrate layer comprises a continuous phase polymeric matrix having dispersed therein substantially only non-crosslinked polymer particles that are immiscible with the polymeric matrix.

The dye-receiving layer 1 may be coated onto layer 2 or coextrusion may be employed to form a composite film of layers 1, 2, and optionally, one or more other layers.

DETAILED DESCRIPTION OF THE INVENTION

The terms as used herein, "top," "upper," and "face" mean the side or toward the side of the element receiving an image. The terms "bottom," "lower side," and "back" mean the side opposite that which receives an image.

The term "voids" or "microvoids" means pores formed in an oriented polymeric film during stretching as the result of a void-initiating particle. In the present invention, these pores are initiated by either inorganic particles, crosslinked organic microbeads, combinations thereof, and combinations with non-crosslinked polymer particles. The term "microbead" means synthesized polymeric spheres which, in the present invention, are crosslinked.

According to the present invention, the structure of the thermal dye-transfer receiving element can vary, but is generally a multilayer structure comprising three sections, namely, a dye-receiving layer, a single-layer or composite compliant film comprising the microvoided layer or layers, and an optional composite support. In addition, tie layers or subbing layers can be employed between adjacent layers within a section or between sections. Typically, the receiving element has a total thickness of from 20 to 400 micrometers, preferably 30 to 300 micrometers.

The dye-receiving layer is any layer that will serve the function of receiving the dye transferred from the dye donor of the thermal element. The terms "dye-receiving layer" and "image-receiving layer" are used synonymously. Suitably it comprises a polymeric binder containing a polyester or a polycarbonate or a combination thereof. A desirable combination includes the polyester and polycarbonate polymers in a weight ratio of from 0.8 to 4.0:1.

In one embodiment of a receiver structure, for example, beneath the dye-receiving layer 1 there is a microvoided layer 2 beneath which there is a second microvoided layer comprised of a second continuous phase polymeric matrix having dispersed therein non-crosslinked polymer particles that are immiscible with the polymeric matrix of said second microvoided layer. This composite comprising the two microvoided layers is laminated to a composite support.

In an alternative embodiment, beneath the microvoided layer, there is a layer comprised of a non-voided polyester or polylactic-acid-based material. The composite comprising these two layers, in addition to the dye-image receiving layer, can be laminated to a composite support.

In a preferred embodiment, as indicated above, beneath the one or more microvoided layers are a paper-containing support, more preferably a resin-coated paper support. The support can comprise one or more subbing layers or tie layers.

Typically, a support comprises cellulose fiber paper. Preferably, the support is from 120 to 250 μm thick and the applied composite laminate film is from 30 to 100 μm thick. The support can further comprise a backing layer, preferably a polyolefin backing layer on the side of the support opposite to the composite film and a tie layer between the support and the laminate film.

The microvoided layer 2 provides more compliant properties to the receiver. This is important as it impacts the degree of contact to the thermal head during printing. Higher compliance results in better contact and higher dye transfer efficiency due to improved thermal transfer. Optional additional underlayer can further provide tearability and process robustness and structural integrity.

The microvoided layer 2 can be a single-layer between the dye-receiving layer and a support or part of a multi-layer film. The microvoided layer comprises a continuous polylactic-acid-based phase and microvoids, wherein inorganic particles (as described above) having an average diameter in the range of 0.1 to 1.5 micrometers, preferably 0.1 to 1.2 micrometers, more preferably 0.2 to 1.0 micrometers, most preferably 0.3 to 0.8 micrometers, are used as microvoiding agents. It is especially advantageous for the average diameter of the particles to be in the range of 0.1 to 0.6 micrometers. Average particle size is that as measured by a Sedigraph® 5100 Particle Size Analysis System (by PsS, Limited). Preferred void initiating particles are inorganic particles, including but not limited to, barium sulfate, calcium carbonate, zinc sulfide, titanium dioxide, silica, alumina, and mixtures thereof, etc. Barium sulfate, zinc sulfide, or titanium dioxide are especially preferred.

Preferably, such single-layer and multiplayer sheets are extruded as a single layer or multi-layer, respectively. It is also advantageous for the extruded or co-extruded layers to be sequentially stretched, first in the machine direction and then in the transverse direction.

As noted above, the microvoided layer comprises a polylactic acid-based material, also referred to herein as a polylactic-acid-containing layer. The polylactic-acid-based material used in the present invention comprises a polylactic-acid-based polymer including polylactic acid or copolymers comprising compatible comonomers such as one or more hydroxycarboxylic acids. Exemplary hydroxycarboxylic acid includes glycolic acid, hydroxybutyric acid, hydroxyvaleric acid, hydroxypentanoic acid, hydroxycaproic acid, and hydroxyheptanoic acid. The polylactic-acid-based material comprises 85 to 100% by weight of a polylactic-acid-based polymer (or PLA-based polymer). The PLA-based polymer preferably comprises from 85 to 100 mol % of a lactic-acid units (preferably derived from L-lactic acid) and optionally polymerization compatible with other comonomers. Preferably, the PLA-based polymer comprises at least 85 mole percent, more preferably at least 90 mole percent, most preferably at least 95 mole percent of lactic-acid monomeric units whether derived from lactic acid monomers or lactide dimers.

Polylactic acid, also referred to as "PLA," used in this invention includes polymers based essentially on single D- or L-isomers of lactic acid, or mixtures thereof. In a preferred embodiment, PLA is a thermoplastic polyester of 2-hydroxy lactate (lactic acid) or lactide units. The formula of the unit is: —[O—CH($CH_3$)—CO]—. The alpha-carbon of the monomer is optically active (L-configuration). The polylactic-acid-based polymer is typically selected from the group consisting of D-polylactic acid, L-polylactic acid, D,L-polylactic acid, meso-polylactic acid, and any combination of D-polylactic acid, L-polylactic acid, D,L-polylactic acid, and meso-polylactic acid. In one embodiment, the polylactic acid-based material includes predominantly PLLA (poly-L-lactic acid). In one embodiment, the number average molecular weight is between about 15,000 and about 1,000,000.

The various physical and mechanical properties vary with change of racemic content, and as the racemic content increases, the PLA becomes amorphous, as described, for example, in U.S. Pat. No. 6,469,133, the contents of which are hereby incorporated by reference. In one embodiment, the polymeric material includes relatively low (less than about 5%) amounts of the racemic form of the polylactic acid. When the PLA content rises above about 5% of the racemic form, the amorphous nature of the racemic form may alter the physical and/or mechanical properties of the resulting material.

Additional polymers can be added to the polylactic-acid-based material so long as they are compatible with the polylactic-acid-based polymers. In one embodiment, compatibility is miscibility (defined as one polymer being able to blend with another polymer without a phase separation between the polymers) such that the polymer and the polylactic-acid-based polymer are miscible under conditions of use. Typically, polymers with some degree of polar character can be used. Suitable polymeric resins that are miscible with polylactic acid to some extent can include, for example, polyvinyl chloride, polyethylene glycol, polyglycolide, ethylene vinyl acetate, polycarbonate, polycaprolactone, polyhydroxyalkanoates (polyesters), polyolefins modified with polar groups such as maleic anhydride and others, ionomers, e.g. SURLYN® (DuPont Company), epoxidized natural rubber and other epoxidized polymers.

In one particular embodiment of the present invention, a polylactic acid comprises a mixture of at least 90%, preferably about 96% poly(L-lactic acid) and at least 15%, preferably about 4% poly(D-lactic acid), which is preferable from the viewpoint of processing durability.

To the polylactic-acid-based material, various kinds of known additives, for example an oxidation inhibitor or an antistatic agent, may be added by a volume which does not destroy the advantages according to the present invention. As mentioned above, the polylactic-acid-containing layer can include up to 15 weight percent of additional polymers or blends of other polyesters in the continuous phase. Optionally, chain extenders can be used for the polymerization, as will be understood by the skilled artisan. Chain extenders include, for example, higher alcohols such as lauryl alcohol and hydroxy acids such as lactic acid and glycolic acid.

The polylactic-acid-containing microvoided layer can comprise one or more thermoplastic polylactic-acid-based polymers (including polymers comprising individual isomers or mixtures of isomers), which film has been biaxially stretched (that is, stretched in both the longitudinal and transverse directions) to create microvoids around void initiating particles. Any suitable polylactic acid or polylactide can be used as long as it can be cast, spun, molded, or otherwise formed into a film or sheet, and can be biaxially oriented as noted above. Generally, the polylactic acids have a glass transition temperature of from about 55 to about 65° C. (preferably from about 58 to about 64° C.) as determined using a differential scanning calorimeter (DSC).

Suitable polylactic-based polymers can be prepared by polymerization of lactic acid or lactide and comprise at least 50% by weight of lactic acid residue repeating units (including lactide residue repeating units), or combinations thereof. These lactic acid and lactide polymers include homopolymers and copolymers such as random and/or block copolymers of lactic acid and/or lactide. The lactic acid residue repeating monomer units may be obtained from L-lactic acid, D-lactic acid, by first forming L-lactide, D-lactide, or LD-lactide, preferably with L-lactic acid isomer levels up to 75%. Examples of commercially available polylactic acid polymers include a variety of polylactic acids that are available from Chronopol Inc. (Golden, Colo.), or polylactides sold under the trade name EcoPLA®. Further examples of suitable commercially available polylactic acid are Natureworks® from Cargill Dow, Lacea® from Mitsui Chemical, or L5000 from Biomer. When using polylactic acid, it may be desirable to have the polylactic acid in the semi-crystalline form.

Polylactic acids may be synthesized by conventionally known methods such as a direct dehydration condensation or lactic acid or a ring-opening polymerization of a cyclic dimer (lactide) of lactic acid in the presence of a catalyst. However, polylactic acid preparation is not limited to these processes. Copolymerization may also be carried out in the above processes by addition of a small amount of glycerol and other polyhydric alcohols, butanetetracarboxylic acid, and other aliphatic polybasic acids, or polysaccharide and other polyhydric alcohols. Further, molecular weight of polylactic acid may be increased by addition of a chain extender such as diisocyanate. Compositions for polylactic-acid-based polymers are also disclosed in U.S. Pat. No. 5,405,887, hereby incorporated by reference.

As indicated above, the microvoided layer can be located between an optional support and an image-receiving layer, for example, used as a compliant layer. The microvoided layer can be part of a monolayer or multi-layer composite film, in the latter case adjacent a second substrate layer. The second substrate layer can be, for example, voided or non-voided polylactic acid-containing layer adjacent to and integral with said microvoided layer. Alternatively, the microvoided layer can be adjacent a support layer that can comprise paper or resin coated paper.

In a preferred embodiment, the thermal-dye-transfer element comprises a substrate comprising at least one microvoided layer that comprises a continuous polylactic-acid-containing first phase and a second phase dispersed within the continuous polylactic-acid-containing first phase, the second phase is comprised of microvoids containing inorganic particles.

In other embodiments, the thermal-dye-transfer element comprises at least one other substrate layer that is arranged adjacent the polylactic-acid-containing layer. This additional polymer layer(s) can be co-extruded with the polylactic acid-containing layer or adhered to it in a suitable manner. Any suitable film-forming polymer (or mixture thereof) can be used in the additional polymer layer(s). The polymer in adjacent layer can be any suitable material that provides a continuous film, including a polyester or polylactic-acid-based material.

In one embodiment, a second voided or unvoided polylactic-acid-containing substrate layer is adjacent to said polylactic acid-containing microvoided layer. The two layers may be integrally formed using a co-extrusion or extrusion coating process. The polylactic acid of the second voided layer can be any of the polylactic acids described previously for the inorganic particle voided layer.

It is possible for the voids of this second voided layer or the microvoided layer to be formed by, instead of particles, by finely dispersing a polymer incompatible with the matrix polylactic-acid-based material and stretching the film uniaxially or biaxially. (It is also possible to have mixtures of particles and incompatible polymers.) When the film is stretched, a void is formed around each particle of the incompatible polymer. Since the formed fine voids operate to diffuse a light, the film is whitened and a higher reflectance can be obtained. The incompatible polymer is a polymer that does not dissolve into the polylactic acid. Examples of such an incompatible polymer include poly-3-methylbutene-1, poly-4-methylpentene-1, polypropylene, polyvinyl-t-butane, 1,4-transpoly-2,3-dimethylbutadiene, polyvinylcyclohexane, polystyrene, polyfluorostyrene, cellulose acetate, cellulose propionate, and polychlorotrifluoroethylene. Among these polymers, polyolefins such as polypropylene are suitable.

In still another embodiment of a thermal-dye-transfer element, paper is laminated to the other side of the polylactic acid-containing layer which does not have thereon the image-receiving layer. In this embodiment, the polylactic-acid-containing layer may be thin, as the paper would provide sufficient stiffness.

The present invention does not require but permits the use or addition of various organic and inorganic materials such as pigments, antiblock agents, antistatic agents, plasticizers, dyes, stabilizers, nucleating agents, and other addenda known in the art to the reflective substrate. These materials may be incorporated into the polylactic-acid-containing phase or they may exist as separate dispersed phases and can be incorporated into the polylactic-acid-containing phase using known techniques.

The polylactic acid-containing microvoided layer, especially when used to function both as a compliant layer and a support has the look and feel of paper, which is desirable to the consumer, has a desirable surface look without pearlescence, presents a smooth desirable image, is weather resistant and resistant to curling under differing humidity conditions, and has high resistance to tearing and deformation.

The microvoided polylactic-acid-containing layer has levels of voiding, thickness, and smoothness adjusted to provide optimum stiffness, and gloss properties. The polylactic acid-containing layer can also provide stiffness to the media and physical integrity to other layers. The thickness of the microvoided polylactic acid layer can be as thick as 30 to 400 μm depending on the required stiffness of the recording element.

Although unnecessary, the microvoided polylactic-acid-containing layer may contain voids that are interconnected or open-celled in structure to increase pore volume as disclosed in commonly assigned, copending U.S. patent application Ser. No. 10/722,887, filed Nov. 26, 2003, by Thomas M. Laney et al., and titled, "POLYLACTIC-ACID-BASED SHEET MATERIAL AND METHOD OF MAKING," hereby incorporated by reference in its entirety. However, interconnected pores may be undesirable when the dye-receiving layer is solvent coated onto the microvoided layer.

Voids in the microvoided polylactic-acid-containing layer may be obtained by using void initiators in the required amount during its fabrication. Such void initiators may be inorganic fillers, as described above, or polymerizable organic materials. The void initiators may be employed in an amount of 30 to 50% by volume in the feed stock for the microvoided polylactic-acid-containing layer prior to extrusion and microvoiding.

Although organic microbeads as well as inorganics can be used as void initiators, inorganics have the significant advantage, as shown in Table 1 below, that the polylactic-acid-based material allows for inorganics to be used in sequential stretch process where polyester does not. Typical polymeric organic materials for the microbeads include polystyrenes, polyamides, fluoro polymers, poly(methyl methacrylate), poly(butyl acrylate), polycarbonates, and polyolefins.

The polylactic acid-containing layer used in this invention may be made on readily available film formation machines such as employed with conventional polyester materials. The substrate is preferably prepared in one step with the microvoided polylactic acid layer can be monoextruded or coextruded and stretched. The one step formation process leads to low manufacturing cost.

The process for adding the inorganic particle or other void initiator to the polylactic-acid-based matrix is not particularly restricted. The particles can be added in an extrusion process utilizing a twin-screw extruder.

A process for producing a preferred embodiment of a film according to the present invention will now be explained. However, the process is not particularly restricted to the following one.

Inorganic particles can be mixed into polylactic-acid-based material in a twin screw extruder at a temperature of 170–250° C. This mixture is extruded through a strand die, cooled in a water bath, and pelletized. The pellets are then dried at 50° C. and fed into an extruder "A."

The molten sheet delivered from the die is cooled and solidified on a drum having a temperature of 40–60° C. while applying either an electrostatic charge or a vacuum. The sheet is stretched in the longitudinal direction at a draw ratio of 2–5 times during passage through a heating chamber at a temperature of 70–90° C. Thereafter, the film is introduced into a tenter while the edges of the film are clamped by clips. In the tenter, the film is stretched in the transverse direction in a heated atmosphere having a temperature of 70–90° C. Although both the draw ratios in the longitudinal and transverse directions are in the range of 2 to 5 times, the area ratio between the non-stretched sheet and the biaxially stretched film is preferably in the range of 9 to 20 times. If the area ratio is greater than 20 times, a breakage of the film is liable to occur. Thereafter, the film is uniformly and gradually cooled to a room temperature, and wound.

Inorganic particles are incorporated into the continuous polylactic acid phase as described below. These particles comprise from about 25 to about 75 weight % (preferably from about 35 to about 65 weight %) of the total microvoided layer. When organic microbeads are employed, the particles may comprise from about 10 to about 45 weight % of the total weight of the microvoided layer. If inorganic particles are blended with other particles lesser amounts may be used. For example, inorganic particles may make up from about 10 to about 60 weight % of the total weight of the microvoided layer when blended with other void initiators to make up at least 20 weight percent total void initiators.

The inorganic particles can be incorporated into the continuous polylactic-acid phase by various means. For example, they can be incorporated during polymerization of the lactic acid or lactide used to make the continuous first phase. Alternatively and preferably, they are incorporated by mixing them into pellets of polylactic acid and extruding the mixture to produce a melt stream that is cooled into the desired sheet containing inorganic particles dispersed within the microvoids.

These inorganic particles are at least partially bordered by voids because they are embedded in the microvoids distributed throughout the continuous polylactic acid first phase. Thus, the microvoids containing the inorganic particles comprise a second phase dispersed within the continuous polylactic-acid first phase. The microvoids generally occupy from about 25 to about 65% (by volume) of the microvoided layer.

The microvoids can be of any particular shape, that is circular, elliptical, convex, or any other shape reflecting the film orientation process and the shape and size of the inorganic particles. The size and ultimate physical properties of the microvoids depend upon the degree and balance of the orientation, temperature and rate of stretching, crystallization characteristics of the polylactic acid, the size and distribution of the inorganic particles, and other considerations that would be apparent to one skilled in the art. Generally, the microvoids are formed when the extruded sheet containing inorganic particles is biaxially stretched using conventional orientation techniques.

Thus, in one embodiment, the polylactic-acid-containing layer used in the practice of this invention can be prepared by:

(a) blending inorganic particles into a desired polylactic-acid-based material as the continuous phase;

(b) forming a sheet of the polylactic-acid-based material containing inorganic particles by extrusion; and (c) stretching the sheet in one and/or transverse directions to form microvoids around the inorganic particles.

In a preferred embodiment, the permeable microvoided layer is extruded as a monolayer film. Preferably, the permeable microvoided layer is stretched at a temperature of under 90° C., preferably at a temperature of 74 to 84° C., more preferably about 78° C.

The crosslinked organic microbeads preferably may comprise a polystyrene, polyacrylate, polyallylic, or poly(methacrylate)polymer. See also commonly assigned, copending U.S. Ser. No. 10/374,639 filed Feb. 26, 2003 by Dennis E. Smith et al., titled "THERMAL DYE-TRANSFER RECEIVING ELEMENT WITH MICROVOIDED SUBSTRATE AND METHOD OF MAKING THE SAME" and U.S. Ser. No. 10/033,457 filed Dec. 27, 2001, by Dennis E. Smith, titled "IMPROVED VOIDED ARTICLES" both of which are hereby incorporated by reference in their entirety.

The non-crosslinked polymer particles in the microvoided layer should be immiscible with the polymeric matrix. Typical non-crosslinked polymer particles that are immiscible with the polylactic-acid-based material are olefins. The preferred olefin non-crosslinked polymer particles which may be blended with the polyester matrix are a homopolymers or copolymers of polypropylene or polyethylene. Polypropylene is preferred.

ride, poly(styrene-co-acrylonitrile), poly(caprolactone), or mixtures thereof. The dye-image receiving layer may be present in any amount which is effective for the intended purpose. In general, good results have been obtained at a concentration of from about 1 to about 5 g/m$^2$. In a preferred embodiment of the invention, the dye-image receiving layer is a polycarbonate, polyester, or blend of the two. The term "polycarbonate" as used herein means a polyester of carbonic acid and a glycol or a dihydric phenol. Examples of such glycols or dihydric phenols are p-xylylene glycol, 2,2-bis(4-oxyphenyl)propane, bis(4-oxyphenyl)methane, 1,1-bis(4-oxyphenyl)ethane, 1,1-bis(oxyphenyl)butane, 1,1-bis(oxyphenyl)cyclohexane, and 2,2-bis(oxyphenyl)butane. In a particularly preferred embodiment, a bisphenol-A polycarbonate having a number average molecular weight of at least about 25,000 is used. Examples of preferred polycarbonates include General Electric LEXAN® Polycarbonate Resin and Bayer AG MACROLON 5700®.

In a preferred embodiment of the invention, the dye-image receiving layer comprises a polymeric binder containing a polyester and/or polycarbonate. In another embodiment, the dye-image receiving layer comprises a blend of a polyester and a polycarbonate polymer. Preferably, such blends comprise the polyester and polycarbonate in a weight ratio of polyester to polycarbonate of 10:90 to 90:10, preferably 0.8:1 to 4.0:1. In the preferred embodiment, the polyester comprises polyethylene(terephthalate) or a blend thereof. For example, in one embodiment of the invention, a polyester polymer is blended with an unmodified bisphenol-A polycarbonate and at a weight ratio to produce the desired Tg of the final blend and to minimize cost. Conveniently, the polycarbonate and polyester polymers may be blended at a weight ratio of from about 75:25 to about 25:75. The following polyester polymers E-1 and E-2 comprised of recurring units of the illustrated monomers, are examples of polyester polymers usable in the receiving layer polymer blends of the invention.

E-1: Polymer derived from 1,4-cyclohexanedicarboxylic acid, 4,4'-bis(2-hydroxyethyl)bisphenol-A, and 1,4-cyclohexanedimethanol represented by the following structure:

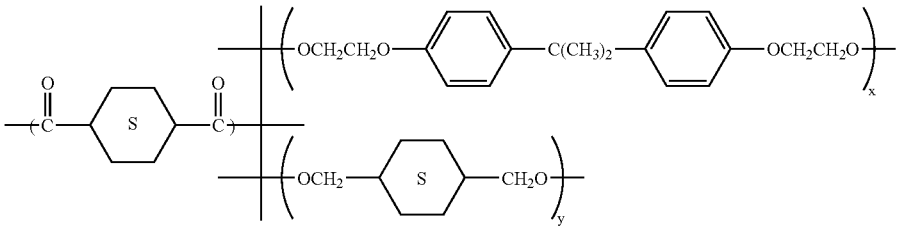

x = 50 mole %
m = 50 mole %
(mole % based on total monomer charge of acid and glycol monomers)

The thermal dye-transfer receiving elements of the invention typically comprise, on the top surface, a dye-image receiving layer that is a non-porous polymeric layer capable of receiving a dye image and comprising, for example, a polycarbonate, a polyurethane, a polyester, polyvinyl chlo- E-2: A polymer, useful in making an extruded dye-receiving layer, is derived from 1,4-cyclohexanedicarboxylic acid, 1,4-cyclohexanedimethanol, 4,4'-bis(2-hydroxyethyl)bisphenol-A, and 2-ethyl-2-(hydroxymethyl)-1,3-propanediol represented by the following structure.

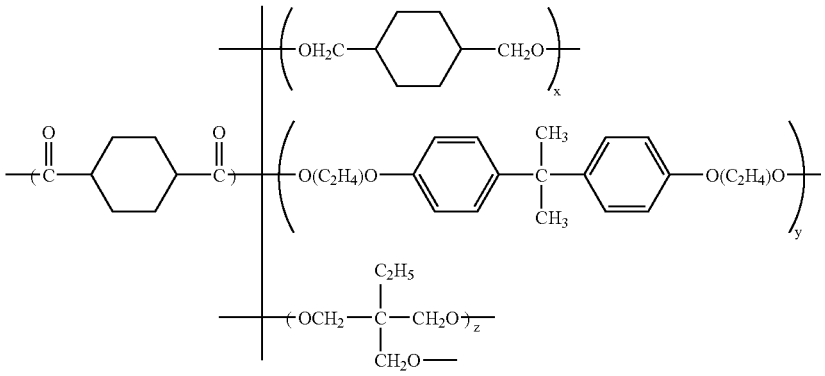

x = 48 mole %
y = 50 mole %
z = 2 mole %

Further examples of polymeric compositions and related processing of dye-receiving layers are disclosed in commonly assigned, copending U.S. Ser. No. 10/376,188 filed Feb. 26, 2003 by Teh-Ming Kung, titled "NOVEL POLYESTER COMPOSITIONS USEFUL FOR IMAGE-RECEIVING LAYERS" hereby incorporated by reference in its entirety.

As conventional, the dye-image receiving layer further can further comprise a release agent. Conventional release agents include, but are not limited to, silicone or fluorine based compounds. Resistance to sticking during thermal printing may be enhanced by the addition of such release agents to the dye-receiving layer or to an overcoat layer. Various releasing agents are disclosed, for example, in U.S. Pat. Nos. 4,820,687 and 4,695,286, the disclosures of which are hereby incorporated by reference in their entirety.

A plasticizer may be present in the dye-image receiving layer in any amount which is effective for the intended purpose. In general, good results have been obtained when the plasticizer is present in an amount of from about 5 to about 100%, preferably from about 10 to about 20%, based on the weight of the polymeric binder in the dye-image receiving layer.

In one embodiment of the invention, an aliphatic ester plasticizer is employed in the dye-image receiving layer. Suitable aliphatic ester plasticizers include both monomeric esters and polymeric esters. Examples of aliphatic monomeric esters include ditridecyl phthalate, dicyclohexyl phthalate, and dioctylsebacate. Examples of aliphatic polyesters include polycaprolactone, poly(1,4-butylene adipate), and poly(hexamethylene sebacate).

In a preferred embodiment of the invention, the monomeric ester is dioctylsebacate or bis-(1-octyloxy-2,2,6,6-tetramethyl-4-piperidinyl) sebacate, Tinuvin 123® (Ciba Geigy Co.). In another preferred embodiment, the aliphatic polyester is poly(1,4-butylene adipate) or the 1,3-butane diol polymer with hexanedioc acid, 2-ethylhexyl ester, poly(1,3-butylene glycol adipate) sold commercially as Admex 429® (Velsicol Chemical Corp.), or poly(hexamethylene sebacate).

If the dye-receiving layer is to be made by extruding rather than by solvent coating the dye-receiving layer, then it has been found advantageous to include, as an additive to the composition of the dye-receiving layer, a phosphorous-containing stabilizer such as phosphorous acid or an organic diphosphite such as bis(2-ethylhexyl)phosphite, to prevent degradation of the polyester polymer blend during high temperature melt extrusion. The phosphorous stabilizer can be combined, for example, with a plasticizer such as dioctyl sebacate or the like. Preferably, to improve compatibility, the plasticizer is combined with the stabilizer prior to combining both with the other components of the dye receiving layer.

Further details of a preferred dye-receiving element are disclosed in copending, commonly assigned U.S. Ser. No. 10/376,188 hereby incorporated by reference.

As mentioned above, a substrate layer under the microvoided layer 2 can comprise one or more voided or non-voided layers. Such layers can comprise any polyester, conveniently comprising a polylactic-acid-based material, polyethylene(terephthalate), or a copolymer thereof, optionally having immiscible particles, suitably particles based on a polyolefin having an olefinic backbone. Examples include polypropylene, polyethylene, and polystyrene, especially polypropylene.

If desired, below the microvoided layer may be disposed an optional support such as a paper support. The total thickness of the receiver may, for example, be from 20 to 400, with values of 30–300 or 50–200 micrometers being typical. Depending on the manufacturing method employed and desired finished properties, the element may include one or more subbing layers between the layers. Such layers may be employed for any of the known reasons such as adhesion or antistatic properties.

As indicated above, the microvoided support or a composite film, preferably coextruded, can be laminated to a support, preferably a composite (multi-layer) support, which support may be either transparent or opaque. Opaque supports include plain paper, coated paper, resin-coated paper such as polyolefin-coated paper, synthetic paper, photographic paper support, melt-extrusion-coated paper, and polyolefin-laminated paper. Biaxially oriented supports include a paper base and a biaxially oriented polyolefin sheet, typically polypropylene, laminated to one or both sides of the paper base. The support may also consist of microporous materials such as polyethylene polymer-containing material sold by PPG Industries, Inc., Pittsburgh, Pa. under the trade name of Teslin®, Tyvek® synthetic paper (DuPont Corp.), impregnated paper such as Duraform®, and OPPalyte® films (Mobil Chemical Co.) and other composite films listed in U.S. Pat. No. 5,244,861. Transparent supports include glass, cellulose derivatives, such as a cellulose ester, cellulose triacetate, cellulose diacetate, cellulose acetate propionate, cellulose acetate butyrate, polyesters, such as poly(ethylene terephthalate), poly(ethylene naphthalate), poly-1,4-cyclohexanedimethylene terephthalate, poly(butylene terephthalate), and copolymers thereof, polyimides, polyamides, polycarbonates, polystyrene, polyolefins, such as polyethylene or polypropylene, polysulfones, polyacrylates, polyether imides, and mixtures thereof. The papers listed above include a broad range of papers, from high end papers, such as photographic paper to low end papers, such as newsprint. In a preferred embodiment, Ektacolor paper made by Eastman Kodak Co. may be employed.

Dye Donor: A dye-donor element that is used with the thermal dye-receiving element of the invention comprises a support having thereon a dye containing layer. Any dye can be used in the dye-donor employed in the invention provided it is transferable to the dye-receiving layer by the action of heat. Especially good results have been obtained with sublimable dyes such as anthraquinone dyes, e.g., Sumikalon Violet RS® (product of Sumitomo Chemical Co., Ltd.), Dianix Fast Violet 3RFS® (product of Mitsubishi Chemical Industries, Ltd.), and Kayalon Polyol Brilliant Blue N-BGM® and KST Black 146® (products of Nippon Kayaku Co., Ltd.); azo dyes such as Kayalon Polyol Brilliant Blue BM®, Kayalon Polyol Dark Blue 2BM®, and KST Black KR® (products of Nippon Kayaku Co., Ltd.), Sumickaron Diazo Black 5G® (product of Sumitomo Chemical Co., Ltd.), and Miktazol Black 5GH (product of Mitsui Toatsu Chemicals, Inc.); direct dyes such as Direct Dark Green B® (product of Mitsubishi Chemical Industries, Ltd.) and Direct Brown M® and Direct Fast Black D® (products of Nippon Kayaku Co. Ltd.); acid dyes such as Kayanol Milling Cyanine 5R® (product of Nippon Kayaku Co. Ltd.); basic dyes such as Sumicacryl Blue 6G® (product of Sumitomo Chemical Co., Ltd.), and Aizen Malachite Green® (product of Hodogaya Chemical Co., Ltd.);

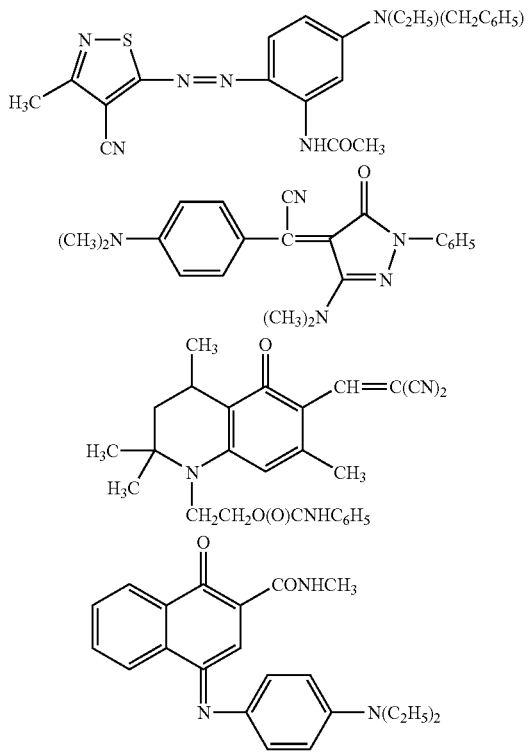

or any of the dyes disclosed in U.S. Pat. No. 4,541,830, the disclosure of which is hereby incorporated by reference. The above dyes may be employed singly or in combination to obtain a monochrome. The dyes may be used at a coverage of from about 0.05 to about 1 g/m2 and are preferably hydrophobic.

The dye in the dye-donor element is dispersed in a polymeric binder such as a cellulose derivative, e.g., cellulose acetate hydrogen phthalate, cellulose acetate, cellulose acetate propionate, cellulose acetate butyrate, cellulose triacetate; a polycarbonate; poly(styrene-co-acrylonitrile), a poly(sulfone) or a poly(phenylene oxide). The binder may be used at a coverage of from about 0.1 to about 5 g/m$^2$.

The dye layer of the dye-donor element may be coated on the support or printed thereon by a printing technique such as a gravure process. The reverse side of the dye-donor element can be coated with a slipping layer to prevent the printing head from sticking to the dye-donor element. Such a slipping layer would comprise a lubricating material such as a surface active agent, a liquid lubricant, a solid lubricant or mixtures thereof, with or without a polymeric binder. Preferred lubricating materials include oils or semi-crystalline organic solids that melt below 100° C. such as poly (vinyl stearate), beeswax, perfluorinated alkyl ester polyethers, poly(caprolactone), carbowax or poly(ethylene glycols). Suitable polymeric binders for the slipping layer include poly(vinyl alcohol-co-butyral), poly(vinyl alcohol-co-acetal), poly(styrene), poly(vinyl acetate), cellulose acetate butyrate, cellulose acetate, or ethyl cellulose.

The amount of the lubricating material to be used in the slipping layer depends largely on the type of lubricating material, but is generally in the range of from about 0.001 to about 2 g/m$^2$. If a polymeric binder is employed, the lubricating material is present in the range of 0.1 to 50 wt %, preferably 0.5 to 40, of the polymeric binder employed.

As noted above, the dye-donor elements and receiving elements of the invention are used to form a dye transfer image. Such a process comprises imagewise-heating a dye-donor element as described above and transferring a dye image to a dye-receiving element to form the dye transfer image.

The dye-donor element may be used in sheet form or in a continuous roll or ribbon. If a continuous roll or ribbon is employed, it may have only one dye thereon or may have alternating areas of different dyes, such as sublimable cyan, magenta, yellow, black, etc., as described in U.S. Pat. No. 4,541,830. Thus, one-, two- three- or four-color elements (or higher numbers also) are included within the scope of the invention.

In a preferred embodiment, the dye-donor element comprises a poly(ethylene terephthalate) support coated with sequential repeating areas of cyan, magenta, and yellow dye, and the above process steps are sequentially performed for each color to obtain a three-color dye transfer image. Of course, when the process is only performed for a single color, then a monochrome dye transfer image is obtained.

Another aspect of the present invention relates to a method of forming an image comprising imagewise thermally transferring dyes onto a receiving element according to the present invention, such that the microbeads soften during the thermal printing process.

In a preferred embodiment of the invention, a dye-donor element may be employed which comprises a poly(ethylene terephthalate) support coated with sequential repeating areas of cyan, magenta, and yellow dye, and the dye transfer steps are sequentially performed for each color to obtain a three-color dye transfer image. Of course, when the process is only performed for a single color, then a monochrome dye transfer image may be obtained. The dye-donor element may also contain a colorless area which may be transferred to the receiving element to provide a protective overcoat. This protective overcoat may be transferred to the receiving element by heating uniformly at an energy level equivalent to 85% of that used to print maximum image dye density.

Thermal printing heads which can be used to transfer dye from the dye-donor elements to the receiving elements are available commercially. There can be employed, for example, a Fujitsu Thermal Head (FTP-040MCS001), a TDK Thermal Head F415 HH7-1089, or a Rohm Thermal Head KE 2008-F3.

A thermal dye transfer assemblage of the invention comprises: a) a dye-donor element as described above, and b) a dye-receiving element as described above, the dye-receiving element being in a superposed relationship with the dye-donor element so that the dye layer of the donor element is in contact with the dye-image receiving layer of the receiving element. The above assemblage comprising these two elements may be pre-assembled as an integral unit when a monochrome image is to be obtained. This may be done by temporarily adhering the two elements together at their margins. After transfer, the dye-receiving element is then peeled apart to reveal the dye transfer image.

When a three-color image is to be obtained, the above assemblage is formed on three occasions during the time when heat is applied by the thermal printing head. After the first dye is transferred, the elements are peeled apart. A second dye-donor element (or another area of the donor element with a different dye area) is then brought in register with the dye-receiving element and the process repeated. The third color is obtained in the same manner.

In a preferred embodiment of the invention, a dye-donor element is employed which comprises a poly(ethylene terephthalate) support coated with sequential repeating areas of cyan, magenta, and yellow dye, and the dye transfer steps are sequentially performed for each color to obtain a three-color dye transfer image. Of course, when the process is only performed for a single color, then a monochrome dye transfer image is obtained. The dye-donor element may also contain a colorless area which is transferred to the receiving element to provide a protective overcoat. This protective overcoat is transferred to the receiving element by heating uniformly at an energy level equivalent to about 85% of that required to print maximum image dye density.

Thermal printing heads which can be used to transfer dye from dye-donor elements to the receiving elements of the invention are available commercially. There can be employed, for example, a Fujitsu Thermal Head (FTP040 MCS001), a TDK Thermal Head F415 HH7-1089, or a Rohm Thermal Head KE 2008-F3. Alternatively, other known sources of energy for thermal dye transfer may be used, such as lasers as described in, for example, GB No. 2,083,726A.

A thermal dye transfer assemblage of the invention comprises (a) a dye-donor element, and (b) a dye-receiving element as described above, the dye-receiving element being in a superposed relationship with the dye-donor element so that the dye layer of the donor element is in contact with the dye-image receiving layer of the receiving element.

When a three-color image is to be obtained, the above assemblage is formed on three occasions during the time when heat is applied by the thermal printing head. After the first dye is transferred, the elements are peeled apart. A second dye-donor element (or another area of the donor element with a different dye area) is then brought in register with the dye-receiving element and the process repeated. The third color is obtained in the same manner.

The following examples are provided to illustrate the invention. They are not intended to be exhaustive of all possible variations of the invention. Parts and percentages are by weight unless otherwise indicated.

EXAMPLES

Preparation of Resin for Image-receiving Layer:

For the examples below the resin pellets used to extrude the image-receiving layer were formulated by introducing the following components into a Leistritz 27 mm Twin Screw Compounding Extruder heated to 210° C.:

1) Polyester: 157.45 kg (914.46 moles) of cis and trans isomers of cyclohexanedicarboxylic acid, 144.66 kg (457.23 moles) of bisphenol A diethanol, 2.45 kg (18.29 moles) of trimethylolpropane, 66.47 kg (460.89 moles) of cis and trans isomers of cyclohexanedimethanol and 82.51 g of butylstannoic acid catalyst were added to a 150 gallon polyester reactor equipped with a low speed helical agitator. The batch was heated to a final temperature of 275° C. The water byproduct of the esterification reaction began to distill over at 171° C. after about two hours of heat-up. Two hours later at an internal temperature of 267° C., the reactor pressure was ramped down at 10 mm Hg per minute to 3 mm Hg absolute pressure. After two hours under vacuum, the pressure was reduced to 1 mm Hg. After 3 hours and 30 minutes the vacuum was relieved with nitrogen and the very viscous polyester was drained from the reactor onto trays which cooled overnight. The solidified polyester was ground through a ¼" screen. The inherent viscosity in methylene chloride at 0.25% solids was 0.58, the absolute Mw was 102,000, the Mw/Mn was 6.3, and the glass transition temperature by DSC on the second heat was 55.8° C.

2) Polycarbonate (Lexan® 141 from GE Polymers) at 29.2% wt.

3) Polyester elastomer with Silicone (MB50-10 from Dow Corning) at 4% wt.

4) Dioctyl Sebacate (from Acros Organics) at 2.6% wt.

5) Poly(1,3-butylene glycol adipate) (Admex®429) at 2.6% wt.

6) Stabilizer (Weston® 619) at 0.2%.

The melted mixture was extruded as a strand into a water bath and then pelletized.

Comparative Example 1

This example illustrates the preparation of a comparative thermal-dye-transfer receiver sheet of the present invention. A Leistritz® 27 mm Twin Screw Compounding Extruder heated to 200° C. was used to mix 1.7 μm beads made from 70 wt % methylmethacrylate crosslinked with 30 wt % divinylbenzene (Tg=160° C.) and polylactic acid, "PLA," NatureWorks® 2002-D from Cargill-Dow. The components were metered into the compounder and one pass was sufficient for dispersion of the beads into the PLA matrix. The microbeads were added to attain a 30% by weight loading in the PLA. The compounded material was extruded through a strand die, cooled in a water bath, and pelletized. The compounded pellets were then dried in a desiccant dryer at 50° C.

Then the resin pellets formulated as described above for the extruded image-receiving layer were dried in a desiccant dryer at 50° C. for 12 hours.

Cast sheets were co-extruded to produce a two layer structure using a 1¼ inch extruder to extrude the compounded pellets of PLA and microbeads, layer (2), and a ¾ inch extruder to extrude the compounded pellets of image-receiving layer, layer 1. Layer 2 was extruded at 220° C. while layer 1 was extruded at 240° C. The melt streams were fed into a 7-inch multi-manifold die also heated at 240° C. As the extruded sheet emerged from the die, it was cast onto a quenching roll set at 55° C. The final dimensions of the continuous cast sheet were 18 cm wide and 680 μm thick. Layer 2 was 640 μm thick. The cast sheet was then stretched simultaneously at 78° C., 3.3 times in the X-direction and 3.3 times in the Y-direction.

The composite film can be produced thick enough to function as a thermal-dye-transfer receiver element. Alternatively, the composite film can be produced thinner than desired for a thermal-dye-transfer receiver element and be converted to a receiver element by laminating the composite film to a support sheet. The support sheet typically can be a paper support or a polymeric support. Any known lamination process can be used, although typically an extrusion lamination process is used. The resulting receiver element can be printed and used in any typical thermal-dye-transfer receiver application.

Example 1

This example illustrates the preparation of one embodiment of a thermal-dye-transfer receiver element of the present invention. A Leistritz® 27 mm Twin Screw Compounding Extruder heated to 200° C. was used to mix 0.3 μm Zinc Sulfide particles (Sachtolith® HD-S by Sachtleben) and polylactic acid, "PLA," NatureWorks® 2002-D from Cargill-Dow. The components were metered into the compounder and one pass was sufficient for dispersion of the particles into the PLA matrix. The Zinc Sulfide particles were added to attain a 55% by weight loading in the PLA. The compounded material was extruded through a strand die, cooled in a water bath, and pelletized. The compounded pellets were then dried in a desiccant dryer at 50° C.

Then the resin pellets formulated as described above for the extruded image-receiving layer were dried in a desiccant dryer at 50° C. for 12 hours.

Cast sheets were co-extruded to produce a two layer structure using a 1¼ inch extruder to extrude the compounded pellets of PLA and Zinc Sulfide, layer 2, and a ¾ inch extruder to extrude the compounded pellets of image-receiving layer, layer 1. Layer 2 was extruded at 220° C. while layer 1 was extruded at 240° C. The melt streams were fed into a 7-inch multi-manifold die also heated at 240° C. As the extruded sheet emerged from the die, it was cast onto a quenching roll set at 55° C. The final dimensions of the continuous cast sheet were 18 cm wide and 680 μm thick. Layer 2 was 640 μm thick. The cast sheet was then stretched simultaneously at 78° C., 3.3 times in the X-direction and 3.3 times in the Y-direction.

The composite film can be produced thick enough to function as a thermal-dye-transfer receiver element. Alternatively, the composite film can be produced thinner than desired for a thermal-dye-transfer receiver element and be converted to a receiver element by laminating the composite film to a support sheet. The support sheet typically can be a paper support or a polymeric support. Any known lamination process can be used, although typically an extrusion lamination process is used. The resulting receiver element can be printed and used in any typical thermal-dye-transfer receiver application.

Example 2

This example illustrates the preparation of another embodiment of a thermal-dye-transfer receiver element of the present invention. A Leistritz® 27 mm Twin Screw Compounding Extruder heated to 200° C. was used to mix 0.8 μm Barium Sulfate particles (Blanc Fixe® XR-HN by Sachteleben) and polylactic acid or PLA, NatureWorks® 2002-D from Cargill-Dow. The components were metered into the compounder and one pass was sufficient for dispersion of the particles into the PLA matrix. The Barium Sulfate particles were added to attain a 58% by weight loading in the PLA. The compounded material was extruded through a strand die, cooled in a water bath, and pelletized. The compounded pellets were then dried in a desiccant dryer at 50° C.

Then the resin pellets formulated as described above for the extruded image-receiving layer were dried in a desiccant dryer at 50° C. for 12 hours.

Cast sheets were co-extruded to produce a two layer structure using a 1¼ inch extruder to extrude the compounded pellets of PLA and Barium Sulfate, layer 2, and a ¾ inch extruder to extrude the compounded pellets of image-receiving layer, layer 1. Layer 2 was extruded at 220° C. while layer 1 was extruded at 240° C. The melt streams were fed into a 7-inch multi-manifold die also heated at 240° C. As the extruded sheet emerged from the die, it was cast onto a quenching roll set at 55° C. The final dimensions of the continuous cast sheet were 18 cm wide and 680 μm thick. Layer 2 was 640 μm thick. The cast sheet was then stretched simultaneously at 78° C., 3.3 times in the X-direction and 3.3 times in the Y-direction.

The composite film can be produced thick enough to function as a thermal-dye-transfer receiver element. Alternatively, the composite film can be produced thinner than desired for a thermal-dye-transfer receiver element and be converted to a receiver element by laminating the composite film to a support sheet. The support sheet typically can be a paper support or a polymeric support. Any known lamination process can be used, although typically an extrusion lamination process is used. The resulting receiver element can be printed and used in any typical thermal-dye-transfer receiver application.

Example 3

This example illustrates the preparation of another embodiment of a thermal-dye-transfer receiver element of the present invention. A Leistritz 27 mm Twin Screw Compounding Extruder heated to 200° C. was used to mix 0.3 μm Zinc Sulfide particles (Sachtolith® HD-S by Sachtleben) and polylactic acid or PLA, NatureWorks 2002-D by Cargill-Dow. The components were metered into the compounder and one pass was sufficient for dispersion of the particles into the PLA matrix. The Zinc Sulfide particles were added to attain a 30% by weight loading in the PLA. The compounded material was extruded through a strand die, cooled in a water bath, and pelletized. The compounded pellets were then dried in a desiccant dryer at 50° C.

Then the resin pellets formulated as described above for the extruded image-receiving layer were dried in a desiccant dryer at 50° C. for 12 hours.

Cast sheets were co-extruded to produce a two layer structure using a 1¼ inch extruder to extrude the compounded pellets of PLA and Zinc Sulfide, layer 2, and a ¾ inch extruder to extrude the compounded pellets of image-receiving layer, layer 1. Layer 2 was extruded at 220° C.

while layer 1 was extruded at 240° C. The melt streams were fed into a 7-inch multi-manifold die also heated at 240° C. As the extruded sheet emerged from the die, it was cast onto a quenching roll set at 55° C. The final dimensions of the continuous cast sheet were 18 cm wide and 680 μm thick. Layer 2 was 640 μm thick. The cast sheet was then stretched simultaneously at 78° C., 3.3 times in the X-direction and 3.3 times in the Y-direction.

The composite film can be produced thick enough to function as a thermal-dye-transfer receiver element. Alternatively, the composite film can be produced thinner than desired for a thermal-dye-transfer receiver element and be converted to a receiver element by laminating the composite film to a support sheet. The support sheet typically can be a paper support or a polymeric support. Any known lamination process can be used, although typically an extrusion lamination process is used. The resulting receiver element can be printed and used in any typical thermal-dye-transfer receiver application.

Example 4

This example illustrates the preparation of another embodiment of a thermal-dye-transfer receiver element of the present invention. A Leistritz® 27 mm Twin Screw Compounding Extruder heated to 200° C. was used to mix 0.8 μm Barium Sulfate particles (Blanc Fixe® XR-HN by Sachteleben) and polylactic acid or PLA, NatureWorks® 2002-D by Cargill-Dow. The components were metered into the compounder and one pass was sufficient for dispersion of the particles into the PLA matrix. The Barium Sulfate particles were added to attain a 30% by weight loading in the PLA. The compounded material was extruded through a strand die, cooled in a water bath, and pelletized. The compounded pellets were then dried in a desiccant dryer at 50° C.

Then the resin pellets formulated as described above for the extruded image-receiving layer were dried in a desiccant dryer at 50° C. for 12 hours.

Cast sheets were co-extruded to produce a two layer structure using a 1¼ inch extruder to extrude the compounded pellets of PLA and Barium Sulfate, layer 2, and a ¾ inch extruder to extrude the compounded pellets of image-receiving layer, layer 1. Layer 2 was extruded at 220° C. while layer 1 was extruded at 240° C. The melt streams were fed into a 7-inch multi-manifold die also heated at 240° C. As the extruded sheet emerged from the die, it was cast onto a quenching roll set at 55° C. The final dimensions of the continuous cast sheet were 18 cm wide and 680 μm thick. Layer 2 was 640 μm thick. The cast sheet was then stretched simultaneously at 78° C., 3.3 times in the X-direction and 3.3 times in the Y-direction.

The composite film can be produced thick enough to function as a thermal-dye-transfer receiver element. Alternatively, the composite film can be produced thinner than desired for a thermal-dye-transfer receiver element and be converted to a receiver element by laminating the composite film to a support sheet. The support sheet typically can be a paper support or a polymeric support. Any known lamination process can be used, although typically an extrusion lamination process is used. The resulting receiver element can be printed and used in any typical thermal-dye-transfer receiver application.

Example 5

This example illustrates the preparation of another embodiment of a thermal-dye-transfer receiver element of the present invention. A Leistritz® 27 mm Twin Screw Compounding Extruder heated to 200° C. was used to mix 0.2 μm Titanium Dioxide particles (R-104 from Dupont) and polylactic acid or PLA, NatureWorks® 2002-D by Cargill-Dow. The components were metered into the compounder and one pass was sufficient for dispersion of the particles into the PLA matrix. The Titanium Dioxide particles were added to attain a 30% by weight loading in the PLA. The compounded material was extruded through a strand die, cooled in a water bath, and pelletized. The compounded pellets were then dried in a desiccant dryer at 50° C.

Then the resin pellets formulated as described above for the extruded image-receiving layer were dried in a desiccant dryer at 50° C. for 12 hours.

Cast sheets were co-extruded to produce a two layer structure using a 1¼ inch extruder to extrude the compounded pellets of PLA and Titanium Dioxide, layer 2, and a ¾ inch extruder to extrude the compounded pellets of image-receiving layer, layer 1. Layer 2 was extruded at 220° C. while layer 1 was extruded at 240° C. The melt streams were fed into a 7-inch multi-manifold die also heated at 240° C. As the extruded sheet emerged from the die, it was cast onto a quenching roll set at 55° C. The final dimensions of the continuous cast sheet were 18 cm wide and 680 μm thick. Layer 2 was 640 μm thick. The cast sheet was then stretched simultaneously at 78° C., 3.3 times in the X-direction and 3.3 times in the Y-direction.

The composite film can be produced thick enough to function as a thermal-dye-transfer receiver element. Alternatively, the composite film can be produced thinner than desired for a thermal-dye-transfer receiver element and be converted to a receiver element by laminating the composite film to a support sheet. The support sheet typically can be a paper support or a polymeric support. Any known lamination process can be used, although typically an extrusion lamination process is used. The resulting receiver element can be printed and used in any typical thermal-dye-transfer receiver application.

Comparaive Example 2

This example illustrates the preparation of a comparative thermal-dye-transfer receiver element. Polylactic acid or PLA, NatureWorks® 2002-D by Cargill-Dow,) was dry blended with Polypropylene ("PP" from Huntsman P4G2Z-073AX). The PP was added at 25% by weight to the PLA. The blended pellets were then dried in a desiccant dryer at 50° C.

Then the polyester-compounded resin pellets formulated as described above for the extruded image-receiving layer were dried in a desiccant dryer at 50° C. for 12 hours.

Cast sheets were co-extruded to produce a two layer structure using a 1¼ inch extruder to extrude the blended pellets of PLA and PP, layer 2, and a ¾ inch extruder to extrude the compounded pellets of image-receiving layer, layer 1. Layer 2 was extruded at 220° C. while layer 1 was extruded at 240° C. The melt streams were fed into a 7-inch multi-manifold die also heated at 240° C. As the extruded sheet emerged from the die, it was cast onto a quenching roll set at 55° C. The final dimensions of the continuous cast sheet were 18 cm wide and 680 μm thick. Layer 2 was 640

μm thick. The cast sheet was then stretched simultaneously at 78° C., 3.3 times in the X-direction and 3.3 times in the Y-direction.

The composite film can be produced thick enough to function as a thermal-dye-transfer receiver element. Alternatively, the composite film can be produced thinner than desired for a thermal-dye-transfer receiver element and be converted to a receiver element by laminating the composite film to a support sheet. The support sheet typically can be a paper support or a polymeric support. Any known lamination process can be used, although typically an extrusion lamination process is used. The resulting receiver element can be printed and used in any typical thermal-dye-transfer receiver application.

Example 6

This example illustrates the preparation of another embodiment of a thermal-dye-transfer receiver element according to the present invention. A Leistritz® 27 mm Twin Screw Compounding Extruder heated to 200° C. was used to mix 0.3 μm Zinc Sulfide particles (Sachtolith® HD-S by Sachtleben) and polylactic acid or "PLA," NatureWorks 2002-D by Cargill-Dow. The components were metered into the compounder and one pass was sufficient for dispersion of the particles into the PLA matrix. The Zinc Sulfide particles were added to attain a 30% by weight loading in the PLA. The compounded material was extruded through a strand die, cooled in a water bath, and pelletized. The PLA-compounded pellets were then dried in a desiccant dryer at 50° C.

Polylactic acid ("PLA"), NatureWorks® 2002-D by Cargill-Dow, was dry blended with Polypropylene ("PP"), Huntsman P4G2Z-073AX. The PP was added at 26% by weight to the PLA. The blended pellets were then dried in a desiccant dryer at 50° C.

Then the resin pellets formulated as described above for the extruded image-receiving layer were dried in a desiccant dryer at 50° C. for 12 hours.

Cast sheets were co-extruded to produce a two layer structure using a 1¼ inch extruder to extrude a 50/50 blend of the blended pellets of PLA and PP and the compounded pellets of PLA and Zinc Sulfide, layer 2, and a ¾ inch extruder to extrude the compounded pellets of image-receiving layer, layer 1. Layer 2 was extruded at 220° C. while layer 1 was extruded at 240° C. The melt streams were fed into a 7-inch multi-manifold die also heated at 240° C. As the extruded sheet emerged from the die, it was cast onto a quenching roll set at 55° C. The final dimensions of the continuous cast sheet were 18 cm wide and 680 μm thick. Layer 2 was 640 μm thick. The cast sheet was then stretched simultaneously at 78° C., 3.3 times in the X-direction and 3.3 times in the Y-direction.

The composite film can be produced thick enough to function as a thermal-dye-transfer receiver element. Alternatively, the composite film can be produced thinner than desired for a thermal-dye-transfer receiver element and be converted to a receiver element by laminating the composite film to a support sheet. The support sheet typically can be a paper support or a polymeric support. Any known lamination process can be used, although typically an extrusion lamination process is used. The resulting receiver element can be printed and used in any typical thermal-dye-transfer receiver application.

Example 7

This example illustrates the preparation of another embodiment of a thermal-dye-transfer receiver element of the present invention. A Leistritz® 27 mm Twin Screw Compounding Extruder heated to 200° C. was used to mix 0.8 μm Barium Sulfate particles (Blanc Fixe® XR-HN by Sachteleben) and polylactic acid or "PLA," NatureWorks 2002-D by Cargill-Dow. The components were metered into the compounder and one pass was sufficient for dispersion of the particles into the PLA matrix. The Barium Sulfate particles were added to attain a 30% by weight loading in the PLA. The compounded material was extruded through a strand die, cooled in a water bath, and pelletized. The compounded pellets were then dried in a desiccant dryer at 50° C.

Polylactic acid (NatureWorks® 2002-D by Cargill-Dow) was dry blended with Polypropylene ("PP"), Huntsman P4G2Z-073AX. The PP was added at 26% by weight to the PLA. The blended pellets were then dried in a desiccant dryer at 50° C.

Then the resin pellets formulated as described above for the extruded image-receiving layer were dried in a desiccant dryer at 50° C. for 12 hours.

Cast sheets were co-extruded to produce a two layer structure using a 1¼ inch extruder to extrude a 50/50 blend of the blended pellets of PLA and PP and the compounded pellets of PLA and Barium Sulfate, layer 2, and a ¾ inch extruder to extrude the compounded pellets of image-receiving layer, layer 1. Layer 2 was extruded at 220° C. while layer 1 was extruded at 240° C. The melt streams were fed into a 7-inch multi-manifold die also heated at 240° C. As the extruded sheet emerged from the die, it was cast onto a quenching roll set at 55° C. The final dimensions of the continuous cast sheet were 18 cm wide and 680 μm thick. Layer 2 was 640 μm thick. The cast sheet was then stretched simultaneously at 78° C., 3.3 times in the X-direction and 3.3 times in the Y-direction.

The composite film can be produced thick enough to function as a thermal-dye-transfer receiver element. Alternatively, the composite film can be produced thinner than desired for a thermal-dye-transfer receiver element and be converted to a receiver element by laminating the composite film to a support sheet. The support sheet typically can be a paper support or a polymeric support. Any known lamination process can be used, although typically an extrusion lamination process is used. The resulting receiver element can be printed and used in any typical thermal-dye-transfer receiver application.

Example 8

This example illustrates the preparation of another embodiment of a thermal-dye-transfer receiver element of the present invention. A Leistritz® 27 mm Twin Screw Compounding Extruder heated to 200° C. was used to mix 0.2 μm Titanium Dioxide particles (R-104 from Dupont) and polylactic acid, NatureWorks® 2002-D by Cargill-Dow ("PLA"). The components were metered into the compounder and one pass was sufficient for dispersion of the particles into the PLA matrix. The Titanium Dioxide particles were added to attain a 30% by weight loading in the PLA. The compounded material was extruded through a strand die, cooled in a water bath, and pelletized. The compounded pellets were then dried in a desiccant dryer at 50° C.

Polylactic acid (NatureWorks® 2002-D by Cargill-Dow) was dry blended with Polypropylene ("PP"), Huntsman P4G2Z-073AX). The PP was added at 26% by weight to the PLA. The blended pellets were then dried in a desiccant dryer at 50° C.

Then the resin pellets formulated as described above for the extruded image-receiving layer were dried in a desiccant dryer at 50° C. for 12 hours.

Cast sheets were co-extruded to produce a two layer structure using a 1¼ inch extruder to extrude a 50/50 blend of the blended pellets of PLA and PP and the compounded pellets of PLA and Titanium Dioxide, layer 2, and a ¾ inch extruder to extrude the compounded pellets of image-receiving layer, layer 1. Layer 2 was extruded at 220° C. while layer 1 was extruded at 240° C. The melt streams were fed into a 7-inch multi-manifold die also heated at 240° C. As the extruded sheet emerged from the die, it was cast onto a quenching roll set at 55° C. The final dimensions of the continuous cast sheet were 18 cm wide and 680 μm thick. Layer 2 was 640 μm thick. The cast sheet was then stretched simultaneously at 78° C., 3.3 times in the X-direction and 3.3 times in the Y-direction.

The composite film can be produced thick enough to function as a thermal-dye-transfer receiver element. Alternatively, the composite film can be produced thinner than desired for a thermal-dye-transfer receiver element and be converted to a receiver element by laminating the composite film to a support sheet. The support sheet typically can be a paper support or a polymeric support. Any known lamination process can be used, although typically an extrusion lamination process is used. The resulting receiver element can be printed and used in any typical thermal-dye-transfer receiver application.

Comparative Example 3

This example illustrates the preparation of a comparative a thermal-dye-transfer receiver element comprising voided polyester. A Leistritz® 27 mm Twin Screw Compounding Extruder heated to 275° C. was used to mix 1.7 μm beads made from 70 wt % methylmethacrylate crosslinked with 30 wt % divinylbenzene (Tg=160° C.) and a 1:1 blend of poly(ethylene terephthalate), referred to as "PET", commercially available as #7352 from Eastman Chemicals, and PETG 6763 polyester copolymer poly(1,4-cyclohexylene dimethylene terephthalate) from Eastman Chemicals. All components were metered into the compounder and one pass was sufficient for dispersion of the beads into the polyester matrix. The microbeads were added to attain a 30% by weight loading in the polyester. The compounded material was extruded through a strand die, cooled in a water bath, and pelletized. The pellets were then dried in a desiccant dryer at 65° C. for 12 hours.

Then the resin pellets formulated as described above for the extruded image-receiving layer were dried in a desiccant dryer at 50° C. for 12 hours.

Cast sheets were co-extruded to produce a two-layer structure using a 1¼ inch extruder to extrude the compounded pellets of polyester and microbeads, layer 2, and a ¾ inch extruder to extrude the compounded pellets of image-receiving layer, layer 1. Layer 2 was extruded at 275° C. while layer 1 was extruded at 250° C. The melt streams were fed into a 7 inch multi-manifold die heated at 275° C. As the extruded sheet emerged from the die, it was cast onto a quenching roll set at 55° C. The final dimensions of the continuous cast sheet were 18 cm wide and 680 μm thick. Layer 2 was 640 μm thick while layer 1 was 40 μm thick. The cast sheet was then stretched simultaneously at 110° C., 3.3 times in the X-direction and 3.3 times in the Y-direction.

The composite film can be produced thick enough to function as a thermal-dye-transfer receiver element. Alternatively, the composite film can be produced thinner than desired for a thermal-dye-transfer receiver element and be converted to a receiver element by laminating the composite film to a support sheet. The support sheet typically can be a paper support or a polymeric support. Any known lamination process can be used, although typically an extrusion lamination process is used. The resulting receiver element can be printed and used in any typical thermal-dye-transfer receiver application.

Comparative Example 4

This example illustrates an attempted preparation of another comparative thermal-dye-transfer receiver element comprising voided polyester, using an inorganic void initiator. A Leistritz® 27 mm Twin Screw Compounding Extruder heated to 275° C. was used to mix 0.3 μM Zinc Sulfide particles (Sachtolith® HD-S by Sachtleben) and a 1:1 blend of poly(ethylene terephthalate), "PET," commercially available as #7352 from Eastman Chemicals, and PETG 6763 polyester copolymer, poly(1,4-cyclohexylene dimethylene terephthalate) from Eastman Chemicals. All components were metered into the compounder and one pass was sufficient for dispersion of the beads into the polyester matrix. The Zinc Sulfide particles were added to attain a 55% by weight loading in the polyester. The compounded material was extruded through a strand die, cooled in a water bath, and pelletized. The compounded pellets were dried in a desiccant dryer at 65° C. for 12 hours.

Then the resin pellets formulated as described above for the extruded image-receiving layer were dried in a desiccant dryer at 50° C. for 12 hours.

Cast sheets were co-extruded to produce a two layer structure using a 1¼ inch extruder to extrude the compounded pellets of polyester and Zinc Sulfide, layer 2, and a ¾ inch extruder to extrude the compounded pellets of image-receiving layer, layer 1. Layer 2 was extruded at 275° C. while layer 1 was extruded at 250° C. The melt streams were fed into a 7-inch multi-manifold die also heated at 275° C. As the extruded sheet emerged from the die, it was cast onto a quenching roll set at 55° C. The final dimensions of the continuous cast sheet were 18 cm wide and 680 μm thick. Layer 2 was 640 μm thick while layer 2 was 130 μm thick. An attempt was then made to stretch the cast sheet simultaneously at 110° C. 3.3 times in the X-direction and 3.3 times in the Y-direction. The sheet continued to tear upon such attempts and the film was deemed non-manufacturable.

Comparative Example 5

This example illustrates an attempted preparation of another comparative thermal-dye-transfer receiver element comprising voided polyester, using a different inorganic void initiator. A Leistritz® 27 mm Twin Screw Compounding Extruder heated to 275° C. was used to mix 0.8 μm Barium Sulfate particles (Blanc Fixe® XR-HN by Sachteleben) and a 1:1 blend of poly(ethylene terephthalate), "PET," commercially available as #7352 from Eastman Chemicals, and PETG 6763 polyester copolymer, poly(1,4-cyclohexylene dimethylene terephthalate) from Eastman Chemicals. All components were metered into the compounder and one pass was sufficient for dispersion of the beads into the polyester matrix. The Barium Sulfate particles were added to attain a 58% by weight loading in the polyester. The compounded material was extruded through a strand die, cooled in a water bath, and pelletized. The compounded pellets were dried in a desiccant dryer at 65° C. for 12 hours.

Then the resin pellets formulated as described above for the extruded image-receiving layer were dried in a desiccant dryer at 50° C. for 12 hours.

Cast sheets were co-extruded to produce a two layer structure using a 1¼ inch extruder to extrude the compounded pellets of polyester and Barium Sulfate, layer 2, and a ¾ inch extruder to extrude the compounded pellets of image-receiving layer, layer 1. Layer 2 was extruded at 275° C. while layer 1 was extruded at 250° C. The melt streams were fed into a 7 inch multi-manifold die also heated at 275° C. As the extruded sheet emerged from the die, it was cast onto a quenching roll set at 55° C. The final dimensions of the continuous cast sheet were 18 cm wide and 680 μm thick. Layer 2 was 640 μm thick while layer 2 was 130 μm thick. An attempt was then made to stretch the cast sheet simultaneously at 110° C., 3.3 times in the X-direction and 3.3 times in the Y-direction. The sheet continued to tear upon such attempts and the film was deemed non-manufacturable.

Preparation of Dye-Donor Elements:

The dye-donor used in the example is Kodak Ektatherm ExtraLife® donor ribbon made as follows:

A 4-patch protective layer dye-donor element was prepared by coating on a 6 μm poly(ethylene terephthalate) support:

1) a subbing layer of DuPont Tyzor® TBT titanium alkoxide (0.12 g/m$^2$) from a n-propyl acetate and n-butyl alcohol solvent mixture; and 2) a slipping layer containing an aminopropyldimethyl-terminated polydimethylsiloxane, PS513® (United Chemical Technologies, Inc.)(0.01 g/m$^2$), a poly(vinyl acetal) binder, KS-1 (Sekisui Co.) (0.38 g/m$^2$), p-toluenesulfonic acid (0.0003 g/m$^2$), polymethylsilsesquioxane beads 0.5 μm (0.06 g/m$^2$), and candellila wax (0.02 g/m$^2$) coated from a solvent mixture of diethyl ketone and methanol.

On the opposite side of the support was coated:

1) a patch-coated subbing layer of DuPont Tyzor® titanium alkoxide (0.13 g/m$^2$) from a n-propyl acetate and n-butyl alcohol solvent mixture; and 2) repeating yellow, magenta, and cyan dye patches containing the compositions as noted below over the subbing layer and a protective patch on the unsubbed portion as identified below.

The yellow composition contained 0.07 g/m$^2$ of a first yellow dye, 0.09 g/m$^2$ of a second yellow dye, 0.25 g/m$^2$ of CAP48220 (20 s viscosity) cellulose acetate propionate, 0.05 g/m$^2$ of Paraplex G-25® plasticizer and 0.004 g/m$^2$ divinylbenzene beads (2 μm beads) in a solvent mixture of toluene, methanol and cyclopentanone (66.5/28.5/5).

The magenta composition contained 0.07 g/m$^2$ of a first magenta dye, 0.14 g/m$^2$ of a second magenta dye, 0.06 g/m$^2$ of a third magenta dye, 0.28 g/m$^2$ of CAP482-20 (20 s viscosity) cellulose acetate propionate, 0.06 g/m$^2$ of Paraplex G-25® plasticizer, 0.05 g/m$^2$ of monomeric glass illustrated below, and 0.005 g/m$^2$ divinylbenzene beads (2 μm beads) in a solvent mixture of toluene, methanol and cyclopentanone (66.5/28.5/5).

The cyan composition contained 0.10 g/m$^2$ of a first cyan dye, 0.09 g/m$^2$ of a second cyan dye, 0.22 g/m$^2$ of a third cyan dye, 0.23 g/m$^2$ of CAP482-20 (20 s viscosity) cellulose acetate propionate, 0.02 g/m$^2$ of Paraplex G-25® plasticizer, 0.04 g/m$^2$ of monomeric glass illustrated below, and 0.009 g/m$^2$ divinylbenzene beads (2 μm beads) in a solvent mixture of toluene, methanol and cyclopentanone (66.5/28.5/5).

The protective patch contained a mixture of poly(vinyl acetal) (0.53 g/m$^2$) (Sekisui KS-10), colloidal silica IPA-ST (Nissan Chemical Co.) (0.39 g/m$^2$) and 0.09 g/m$^2$ of divinylbenzene beads (4 μm beads) which was coated from a solvent mixture of diethylketone and isopropyl alcohol (80:20).

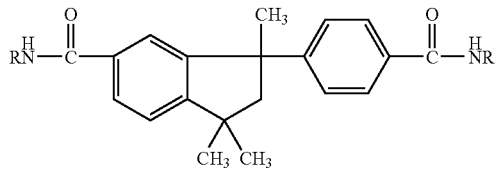

Monomeric Glass wherein R is

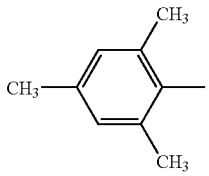

Printing and Evaluation

Table 1 shows a brief description of each example as well as surface roughness of the backside (each layer 2 surface) and the estimated void volume of layer 2 in each example. Surface roughness (Ra) was determined using an optical 3-D roughness gauge and void volume was estimated by void volume fraction defined as the ratio of voided thickness minus unvoided thickness to the voided thickness. Photomicroscopy of a cross-section can be used to determine the actual thickness. The unvoided thickness is defined as the thickness that would be expected had no voiding occurred, for example, the cast thickness divided by the stretch ratio in the machine direction and the stretch ratio in the cross direction.

Table 1 also shows the dye-transfer printing efficiency/quality of the thermal dye-transfer receiver sheet according to the present invention. An 11-step sensitometric full color image was prepared from the above dye-donor and dye-receiver (receiver sheet) of Examples 1 thru 9, as well as comparative examples 1, 2, and 3 (comparative examples 4 and 5 were not manufacturable), by printing the donor-receiver assemblage in a Kodak® 8650 Thermal Printer. The dye-donor element was first placed in contact with the polymeric image-receiving layer (IRL) side of the receiver sheet. The assemblage was positioned on an 18 mm platen roller and a TDK LV5406A thermal head with a head load of 6.35 kg pressed against the platen roller. The TDK LV5406A thermal print head has 2560 independently addressable heaters with a resolution of 300 dots/inch and an average resistance of 3314 Ω. The imaging electronics were activated when an initial print head temperature of 36.4° C. had been reached. The assemblage was drawn between the printing head and platen roller at 16.9 mm/sec. Coincidentally, the resistive elements in the thermal print head were pulsed on for 58 μsec every 76 μsec. Printing maximum density required 64 pulses "on" time per printed line of 5.0 msec. The voltage supplied at 13.6 volts resulted in an instantaneous peak power of approximately 58.18×10−3 Watt/dot and the maximum total energy required to print Dmax was 0.216 mJoules/dot. This printing process did not heat the protective laminate patch as the protective laminate was not desired in order to measure dye density and non-laminated gloss.

After printing, Status A reflection densities of the 11-stepped image were measured with an X-Rite® Model 820 densitometer (X-Rite Corp., Grandville, Mich.). The optical densities, $OD_{max}$ and $OD_{low}$, of yellow, magenta, and cyan colors (Status A reflection densities at step 1 and step 7, respectively) are shown in Table 1.

Table 1 further shows the 20 degree and 60 degree Gardner gloss measurements of each sample.

TABLE 1

| Sample | Description | Particulate Void Initiator Size (μm) | Surface Roughness (Ra) (micro-inches) | % Void Volume | IRL OD max Y/M/C | IRL OD low Y/M/C | IRL 20 Degree Gloss (no laminate) | IRL 60 Degree Gloss (No laminate) |
|---|---|---|---|---|---|---|---|---|
| Comparative 1 | 30% wt X-linked beads/PLA | 1.7 | 15 | 64 | 1.90, 1.86, 2.04 | 0.31, 0.27, 0.29 | 5 | 30 |
| Example 1 | 55% ZnS/PLA | 0.3 | 11 | 51 | 1.93, 1.79, 1.92 | 0.35, 0.28, 0.27 | 40 | 78 |
| Example 2 | 58% $BaSO_4$/PLA | 0.8 | 11 | 67 | 1.91, 1.84, 1.98 | 0.32, 0.27, 0.27 | 44 | 80 |
| Example 3 | 30% ZnS/PLA | 0.3 | 12 | 36 | 1.76, 1.51, 1.71 | 0.36, 0.30, 0.29 | 25 | 68 |
| Example 4 | 30% $BaSO_4$/PLA | 0.8 | 13 | 35 | 1.77, 1.57, 1.75 | 0.26, 0.23, 0.23 | 20 | 68 |
| Example 5 | 30% TiO2/PLA | 0.2 | 9 | 48 | 1.73, 1.53, 1.74 | 0.28, 0.22, 0.22 | 37 | 76 |
| Comparative 2 | 25% PP/PLA | >10 | 39 | 42 | 1.83, 1.66, 1.88 | 0.22, 0.17, 0.19 | 8 | 38 |
| Example 6 | 15% ZnS + 13% PP/PLA | 0.3 | 24 | 36 | 1.91, 1.73, 1.94 | 0.33, 0.26, 0.29 | 5 | 26 |
| Example 7 | 15% $BaSO_4$ + 13% PP/PLA | 0.8 | 18 | 41 | 1.87, 1.72, 1.89 | 0.31, 0.30, 0.26 | 13 | 58 |
| Example 8 | 15% $TiO_2$ + 13% PP/PLA | 0.2 | 13 | 36 | 1.88, 1.75, 1.94 | 0.34, 0.37, 0.30 | 15 | 53 |
| Comparative 3 | 30% wt X-linked beads/PET&PETG | 1.7 | 31 | 22 | 1.60, 1.42, 1.68 | 0.12, 0.12, 0.12 | 8 | 40 |
| Comparative 4 | 55% ZnS/PETG&PET | 0.3 | NA | NA | NA | NA | NA | NA |
| Comparative 5 | 58% $BaSO_4$/PETG&PET | 0.2 | NA | NA | NA | NA | NA | NA |

The data in Table 1 indicates that the voided PLA support under an image-receiving layer offers significant improvement in printed dye density, compared to the polyester. It also shows that if smaller particles (not more than 1.5 μm) are used to void the PLA support that surface gloss can be attained at high levels (60 degree Gardner gloss greater than 45, preferably greater than 50, more preferably greater than 55). It is also noted that the use of such small particles in the PLA support is robust, as compared to being neither robust nor even manufacturable when using polyester as the voided matrix polymer. The use of small particles in combination with immiscible polymer (Examples 7 and 8) may help to increase the lower gloss levels that tend to result in such blends.

The invention has been described in detail with particular reference to certain preferred embodiments thereof, but it will be understood that variations and modifications can be effected within the spirit and scope of the invention.

The invention claimed is:

1. A thermal dye-transfer receiver element comprising:

(a) a dye-receiving layer 1;

(b) beneath layer 1, a microvoided layer 2 comprising, in a continuous phase, a polylactic-acid-based material, wherein microvoids in the microvoided layer provide a void volume of at least 25% by volume, and wherein at least about half of the microvoids are formed from void initiating particles less than 1.5 micrometer in average diameter; and (c) beneath layer 2, an optional support layer 3.

2. The element of claim 1 wherein the particles are in the range of 0.1 to 1.0 micrometers in average diameter.

3. The element of claim 2 wherein the particles are in the range of about 0.2 to about 0.8 micrometers in average diameter.

4. The sheet of claim 1 wherein the dye-receiving layer exhibits a 60 degree gloss of greater than 45.

5. The sheet of claim 4 wherein the dye-receiving layer exhibits a 60 degree gloss of greater than 55.

6. The element of claim 1 wherein the microvoided layer is extruded or coextruded.

7. The element of claim 1 wherein the microvoided layer is biaxially oriented.

8. The element of claim 1 wherein the polylactic-acid-based material is composed of at least 75% by weight of poly(L-lactic acid).

9. The element of claim 1 wherein the particles are inorganic and make up from about 25 to about 75 weight % of the total weight of the microvoided layer.

10. The element of claim 1 wherein the particles are inorganic and make up from about 10 to about 60 weight % of the total weight of the microvoided layer and are blended with other void initiators to make up at least 20 weight percent total void initiators.

11. The element of claim 1 wherein the particles are organic and comprise from about 10 to about 45 weight % of the total weight of the microvoided layer.

12. The element of claim 1 wherein said polylactic-acid-based material is a mixture of at least 90% poly(L-lactic acid) and at least 1% poly(D-lactic acid).

13. The element of claim 9 wherein the inorganic particles are present in an amount between 35 to 65 weight percent.

14. The element of claim 9 wherein the inorganic particles are selected from the group consisting of barium sulfate, calcium carbonate, zinc sulfide, zinc oxide, titanium dioxide, silica, alumina, and combinations thereof.

15. The element of claim 14 wherein the inorganic particles have an average size of from 0.3 to 1.0 μm.

16. The element of claim 1 wherein the microvoided layer is in a coextruded multi-layer film below the dye-receiving layer.

17. The element of claim 16 wherein below the microvoided layer is a substrate layer that comprises a voided or non-voided polylactic-acid-based material and is adjacent to and integral with the microvoided layer.

18. The element of claim 1 wherein the continuous phase comprises additional polymers or blends of other polyesters.

19. The element of claim 1 wherein the element further comprises the support layer, which support layer comprises paper.

20. The element of claim 1 wherein the support layer is present and comprises a polymer sheet.

21. The element of claim 1 wherein one or more subbing layers are present between layers in the element.

22. The element of claim 1 wherein the support layer is present and has a thickness of from 120 to 250 μm thick and the microvoided layer is part of a composite coextruded film that is from 30 to 50 μm thick.

23. The element of claim 1 wherein the support layer is present and comprises a polyolefin backing layer located on a side of the support layer opposite to the microvoided layer.

24. The element of claim 1 wherein the microvoided layer is the upper microvoided layer of a composite film in which below the microvoided layer is a substrate core layer and below the substrate core layer is a lower second microvoided layer.

25. The element of claim 24 wherein the upper and lower microvoided layers consist of a same material and the substrate core layer is non-voided.

26. The element of claim 24 wherein the substrate core layer is comprised of a non-voided polylactic-acid-based material or a polylactic-acid-based material voided with non-crosslinked polymer particles.

27. The element of claim 1 wherein the polylactic-acid-based material comprises additional polymers or blends of other polyesters.

28. The element of claim 1 wherein the dye-receiving layer comprises a polyester material.

29. The element of claim 1 wherein the microvoided layer comprises, in a continuous phase, polylactic-acid-based material having dispersed therein a blend of inorganic and non-crosslinked polymer particles that are immiscible with the polylactic-acid-based material.

30. The element of claim 29 wherein the ratio of the volume of inorganic to the volume of the non-crosslinked polymer particles that are immiscible with the polylactic-acid-based material is from 4:1 to 1:4.

31. The element of claim 29 wherein the non-crosslinked polymer particles that are immiscible with the polylactic-acid-based material have an olefinic backbone.

32. The element of claim 1 wherein the thickness of the microvoided layer is from 20 to 150 micrometers.

33. The element of claim 1 wherein the dye-receiving layer comprises a polymeric binder containing a polyester and/or polycarbonate.

34. A thermal-dye-transfer assemblage comprising a dye-donor element, and the element of claim 1.

35. A thermal dye transfer assemblage comprising a dye-donor element, and the dye-transfer receiver element of claim 1.

36. A method of forming an image comprising imagewise thermally transferring dyes onto the thermal dye-transfer receiver element of claim 1.

* * * * *